US011885197B2

(12) United States Patent
Patil et al.

(10) Patent No.: US 11,885,197 B2
(45) Date of Patent: Jan. 30, 2024

(54) EXTERNAL SLEEVE CEMENTER

(71) Applicant: Halliburton Energy Services, Inc., Houston, TX (US)

(72) Inventors: Ishwar Patil, Houston, TX (US); Priyanshkumar Desai, Houston, TX (US); Lonnie Carl Helms, Houston, TX (US); Frank Vinicia Acosta Villarreal, Houston, TX (US); Handoko Tirto Santoso, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 200 days.

(21) Appl. No.: 17/515,942

(22) Filed: Nov. 1, 2021

(65) Prior Publication Data

US 2023/0139858 A1 May 4, 2023

(51) Int. Cl.
*E21B 34/14* (2006.01)
*E21B 33/14* (2006.01)

(52) U.S. Cl.
CPC ..... *E21B 33/146* (2013.01); *E21B 34/14* (2013.01); *E21B 2200/06* (2020.05)

(58) Field of Classification Search
CPC ..... E21B 33/146; E21B 33/16; E21B 33/165; E21B 33/167; E21B 34/14; E21B 34/142; E21B 2200/06; E21B 33/14
See application file for complete search history.

(56) References Cited

U.S. PATENT DOCUMENTS 2,655,216 A * 10/1953 Baker ..... E21B 33/146 166/188
2,925,865 A * 2/1960 Oliver ..... E21B 33/16 166/117
3,527,297 A * 9/1970 Todd ..... E21B 34/142 166/318
3,948,322 A 4/1976 Baker
4,487,263 A * 12/1984 Jani ..... E21B 33/16 166/194
4,674,569 A 6/1987 Revils et al.
5,048,611 A * 9/1991 Cochran ..... E21B 34/142 166/321
5,279,370 A 1/1994 Brandell et al.
(Continued)

FOREIGN PATENT DOCUMENTS

EP 1262629 A1 12/2002

OTHER PUBLICATIONS

Halliburton Catalog titled "Casing Equipment" (2015), entire catalog.

(Continued)

*Primary Examiner* — Kipp C Wallace
(74) *Attorney, Agent, or Firm* — McAfee & Taft

(57) ABSTRACT

A stage cementing tool for use in a wellbore comprises a mandrel having a plurality of circumferentially spaced first longitudinal slots and a plurality of circumferentially spaced second longitudinal slots. An opening sleeve is disposed in the mandrel in a first position and movable relative thereto. A setting sleeve disposed about the mandrel is connected to the opening sleeve and movable therewith. A drive sleeve disposed in the mandrel above the opening sleeve is connected to and movable with a closing sleeve disposed about the mandrel.

20 Claims, 8 Drawing Sheets

(56) References Cited

U.S. PATENT DOCUMENTS

| | | | | |
|---|---|---|---|---|
| 5,314,015 | A * | 5/1994 | Streich | E21B 34/142 166/187 |
| 5,526,878 | A * | 6/1996 | Duell | E21B 33/127 166/187 |
| 5,647,434 | A | 7/1997 | Sullaway et al. | |
| 5,765,641 | A | 6/1998 | Shy et al. | |
| 6,026,903 | A | 2/2000 | Shy et al. | |
| 6,244,342 | B1 | 6/2001 | Sullaway et al. | |
| 6,802,373 | B2 | 10/2004 | Dillenbeck et al. | |
| 7,086,479 | B2 * | 8/2006 | Schultz | E21B 43/103 166/334.1 |
| 7,857,052 | B2 | 12/2010 | Giroux et al. | |
| 8,215,404 | B2 | 7/2012 | Makowiecki et al. | |
| 8,267,174 | B2 * | 9/2012 | Rogers | E21B 33/146 166/285 |
| 8,616,276 | B2 | 12/2013 | Tips et al. | |
| 8,646,537 | B2 | 2/2014 | Tips et al. | |
| 8,720,561 | B2 | 5/2014 | Zhou | |
| 9,010,442 | B2 | 4/2015 | Streich et al. | |
| 9,291,007 | B2 | 3/2016 | Darbe et al. | |
| 9,441,440 | B2 | 9/2016 | Hofman et al. | |
| 9,441,446 | B2 | 9/2016 | Fripp et al. | |
| 9,506,324 | B2 | 11/2016 | Kyle et al. | |
| 9,587,486 | B2 | 3/2017 | Walton et al. | |
| 9,816,351 | B2 | 11/2017 | Lirette et al. | |
| 9,920,620 | B2 | 3/2018 | Murphree et al. | |
| 10,024,150 | B2 | 7/2018 | Andreychuk et al. | |
| 10,316,619 | B2 | 6/2019 | de Oliveira et al. | |
| 10,358,914 | B2 | 7/2019 | Roberson et al. | |
| 10,557,329 | B2 | 2/2020 | Gao et al. | |
| 10,890,047 | B2 * | 1/2021 | Themig | E21B 33/146 |
| 11,306,562 | B1 * | 4/2022 | Giroux | E21B 34/142 |
| 2006/0207765 | A1 | 9/2006 | Hofman | |
| 2009/0151960 | A1 | 6/2009 | Rogers et al. | |
| 2010/0051276 | A1 * | 3/2010 | Rogers | E21B 33/146 166/289 |
| 2013/0048290 | A1 | 2/2013 | Howell et al. | |
| 2013/0233572 | A1 * | 9/2013 | Helms | E21B 33/146 166/387 |
| 2015/0184489 | A1 | 7/2015 | Resweber | |
| 2015/0345252 | A1 | 12/2015 | McNabb et al. | |
| 2016/0138367 | A1 | 5/2016 | Lirette et al. | |
| 2019/0017366 | A1 | 1/2019 | Alaas et al. | |
| 2019/0249549 | A1 | 8/2019 | Fripp et al. | |
| 2020/0378216 | A1 | 12/2020 | Acosta et al. | |
| 2021/0010345 | A1 * | 1/2021 | Acosta | E21B 33/146 |
| 2023/0127807 | A1 * | 4/2023 | Jiral | E21B 34/142 166/316 |

OTHER PUBLICATIONS

Halliburton Brochure, "Cementing ES II Stage Cementer," Feb. 2009.

Halliburton Brochure, "Fidelis Stage Cementer," Sep. 2013.

International Search Report and Written Opinion dated Apr. 5, 2021, in PCT Application No. PCT/US2020/053694.

International Search Report and Written Opinion dated Jan. 13, 2023, in corresponding PCT Application No. PCT/US2022/042765.

* cited by examiner

EXTERNAL SLEEVE CEMENTER

BACKGROUND

When completing a subterranean well, casing is typically inserted into the wellbore and secured in place by injecting cement within the casing. The cement is forced through a lower end of the casing and into an annulus between the casing and wellbore wall. A displacement fluid is pumped into the casing above a plug to urge the plug downward through the casing to extrude the cement from the casing outlet and back up into the annulus. In some instances, it is impossible or impractical to cement the entire well.

To overcome the problems of a single stage cement process, the casing string is cemented in sections, which is known as a staging process. Staging involves placing cement staging tools integral within the casing string; the staging tools allow cement to flow downward therethrough to a lower section of the casing string during primary or first stage cementing operations. When the portion of the casing string below the particular staging tool is cemented to the well, the staging tool will divert cement into the surrounding annulus where the cement can flow upwards in the annulus.

At times, it is desired to cancel a stage of cementing after the tool has been lowered into the wellbore.

BRIEF DESCRIPTION OF THE DRAWINGS

FIG. 6 is a cross section of the stage cementing tool of FIG. 2 moved to the set position with a cancellation plug.

DESCRIPTION OF AN EMBODIMENT

Figure 1:
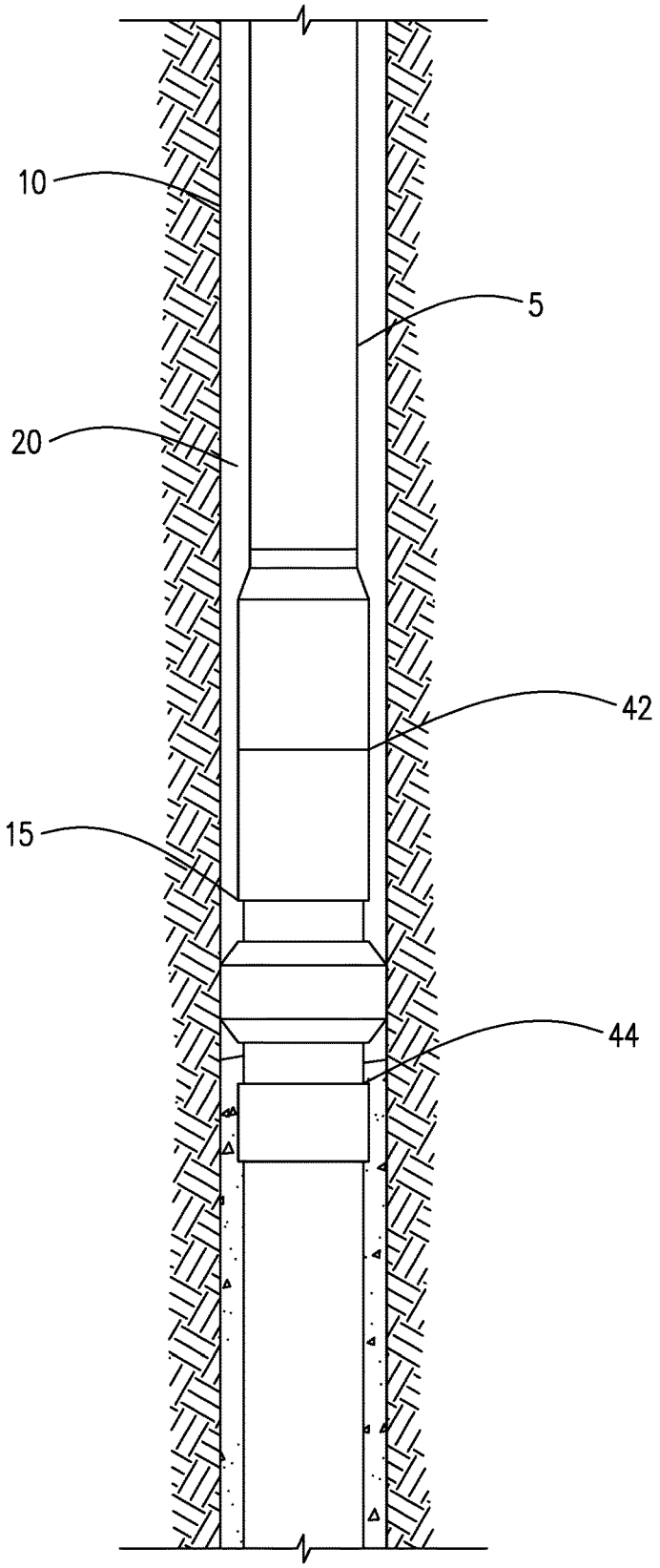
FIG. 1 is a schematic showing a stage cementing tool in a wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Figure 7:
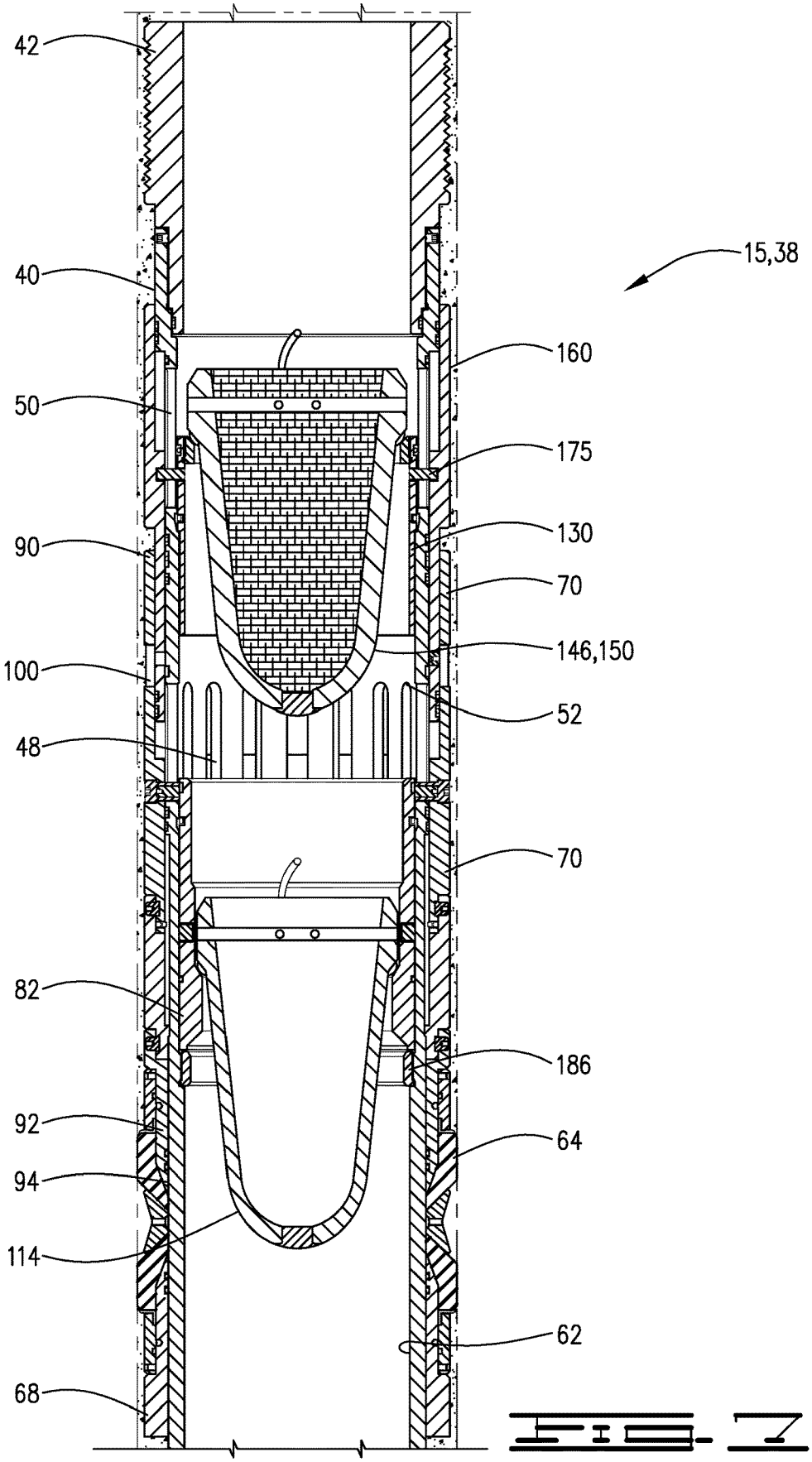
FIG. 7 is a cross section of the stage cementing tool of FIG. 2 with an opening plug and a cancellation plug.
Figure 8:
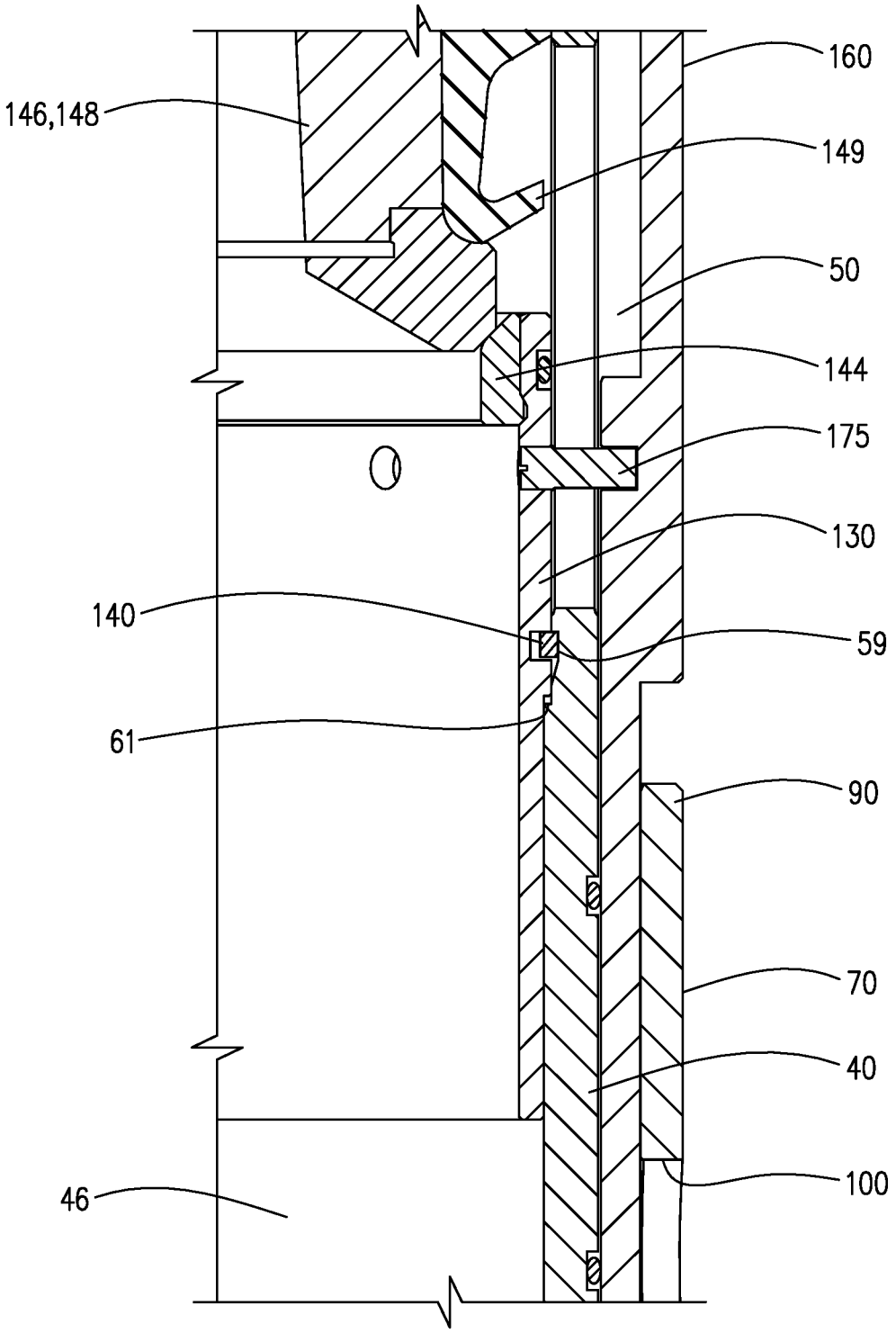
FIG. 8 is an expanded view of a portion of the mandrel.

Unless otherwise specified, use of the terms "up," "upper," "upward," "up-hole," "upstream," or other like terms shall be construed as generally toward the surface; likewise, use of "down," "lower," "downward," "down-hole," "downstream," or other like terms shall be construed as generally away from the surface, regardless of the wellbore orientation. Use of any one or more of the foregoing terms shall not be construed as denoting positions along a perfectly vertical axis. FIG. 1 schematically discloses a stage cementing tool 15 disposed in a wellbore 10. Stage cementing tool 15 is connected in a casing 5. FIG. 1 also shows cement below stage cementing tool 15 which will have occurred in a prior cementing stage. An annulus 20 is defined by and between casing 5 and wellbore 10 and thus between stage cementing tool 15 and wellbore 10. Stage cementing tool 15 has a run-in position 25, shown in FIG. 2, a set position 30 shown in FIG. 3, a cementing position 32 shown in FIG. 4 and a completed position 34 shown in FIG. 5. As is evident from the drawings, in the cementing and completed positions the tool 15 remains in the set position. When referred to herein as the set position, it is that position when the packer described herein is set, but prior to the time the stage cementing tool 15 moves to the cementing position. Stage cementing tool 15 also has two cancelled positions, which occur when it is determined that no cement is to be placed in the annulus through stage cementing tool 15. The first cancelled position 36 is shown in FIG. 6 and the second cancelled position 38 is shown in FIG. 7.

Stage cementing tool 15 comprises a mandrel 40 with upper end 42 and lower end 44. Upper and lower ends 42 and 44 are both connectable in casing 5 and may form a part thereof. Mandrel 40 defines a central flow passage 46 therethrough. A plurality of first longitudinal slots 48 are defined in mandrel 40. First longitudinal slots 48 are spaced around mandrel 40 and may be referred to as a plurality of circumferentially spaced first longitudinal slots. A plurality of second longitudinal slots 50 are defined in mandrel 40. Second longitudinal slots 50 are spaced around mandrel 40 and may be referred to as a plurality of circumferentially spaced second longitudinal slots. Second longitudinal slots 50 are defined in mandrel 40 above and longitudinally spaced from the plurality of first longitudinal slots 48. Longitudinal slots 48 have upper end 52 and lower end 54. Longitudinal slots 50 have upper end 56 and lower end 58. Mandrel 40 has an outer surface 60 and an inner surface 62. A groove containing an O-ring seal 49 is defined in outer surface 60 of mandrel 40 below the plurality of first longitudinal slots 48. A groove 59 is defined in inner surface 62 of mandrel 40 below second longitudinal slots 50. A bottom of groove 59 defines an upward facing shoulder 61.

Figure 2:
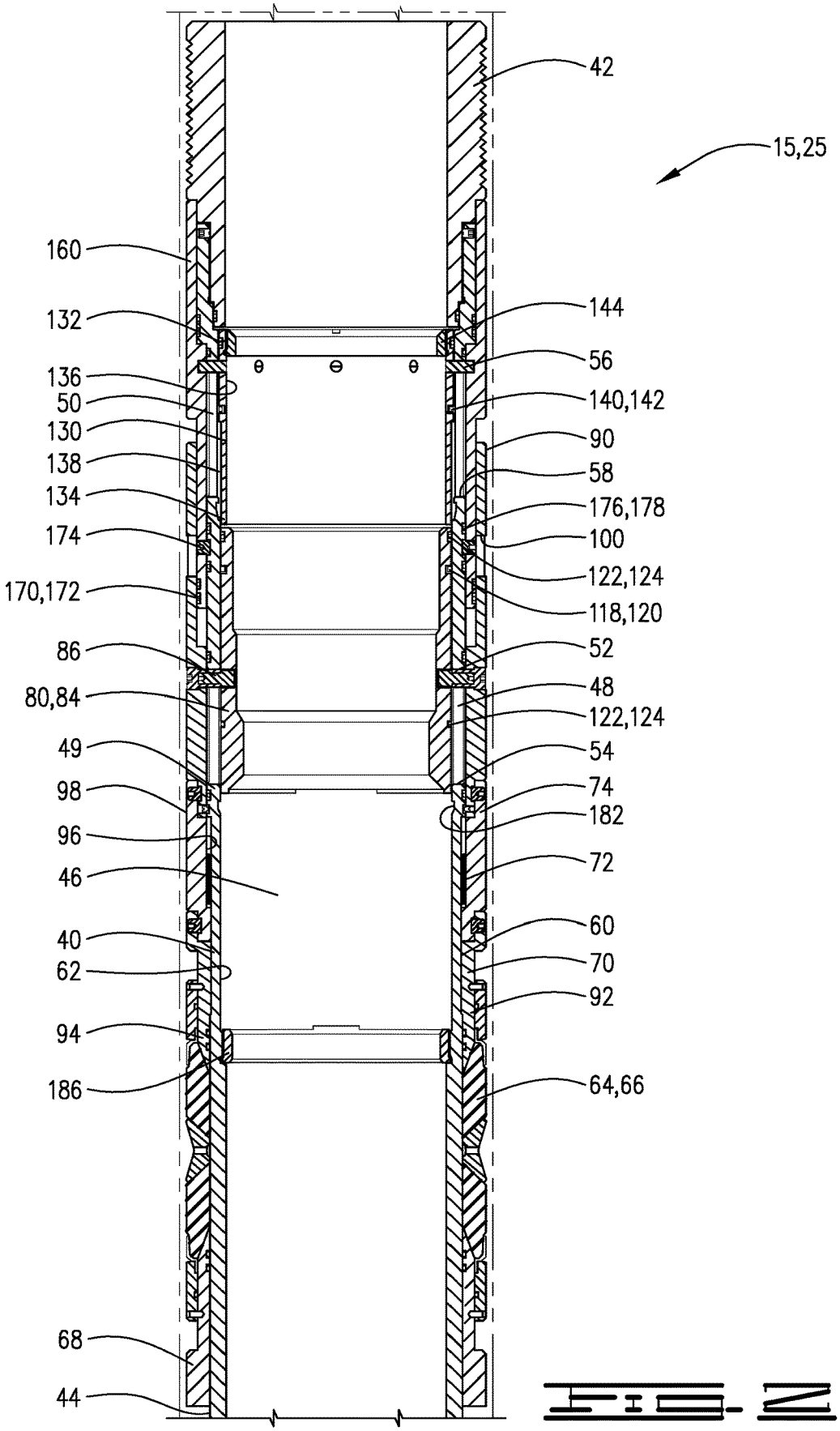
FIG. 2 is a cross section of a stage cementing tool in a run-in position.
Figure 3:
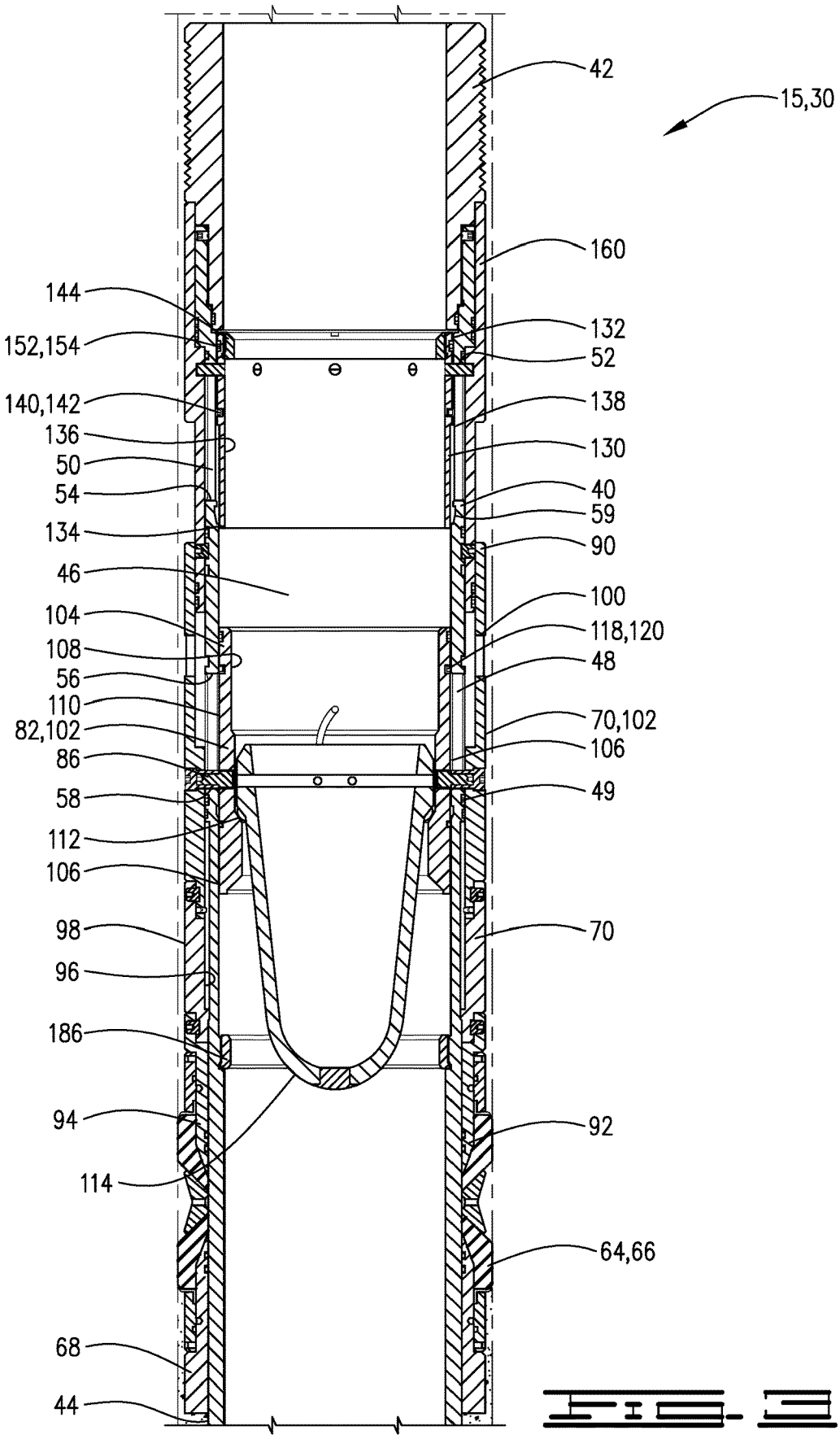
FIG. 3 is a cross section of the stage cementing tool of FIG. 2 in a set position.

A packer 64 that is movable from an unset position as shown in FIG. 2 to the set position shown in FIG. 3 is disposed about mandrel 40. Packer 64 comprises a packer element 66 that is an expandable packer element and a fixed wedge 68 disposed about mandrel 40 below packer element 66. A setting sleeve 70 that is movable on mandrel 40 is disposed about mandrel 40. A body lock ring 72 is disposed between setting sleeve 70 and outer surface 60 of mandrel 40. Body lock ring 72 will prevent setting sleeve 70 from moving upwardly relative to mandrel 40 after the packer 64 is moved to the set position. Body lock rings are known in the art, and act like a ratchet so that upward movement of setting sleeve 70 is prevented after each incremental downward movement. A plurality of shear pins 74 detachably connect setting sleeve 70 to mandrel 40. O-ring seal 49 provides a seal between setting sleeve 70 and mandrel 40 below first longitudinal slots 48.

Stage cementing tool 15 comprises a cementing valve 80. Cementing valve 80 comprises opening sleeve 82 and setting sleeve 70. FIG. 2 shows the first position 84 of opening sleeve 82 and setting sleeve 70. First position 84 of the opening sleeve 82 and setting sleeve 70 is the run-in position of cementing tool 15. Opening sleeve 82 is connected to setting sleeve 70 with at least one and preferably a plurality of drive pins 86 that are shearable drive pins 86. Drive pins 86 extend through the plurality of first longitudinal slots 48. Thus, opening sleeve 82 and setting sleeve 70 are connected to one another and are movable together. Setting sleeve 70 has upper end 90 and lower end 92. A setting wedge 94 is defined at lower end 92 of setting sleeve 70. Setting sleeve 70 has inner surface 96, outer surface 98 and a plurality of cement flow ports 100 defined therein. Cement flow ports 100 may comprise circular ports, or elongated slots. In the embodiment described, there are sixteen (16) first longitudinal slots 48 equally spaced around mandrel 40 and sixteen (16) cement flow ports 100 equally spaced around setting sleeve 70, but other numbers of flow ports 100 and longitudinal slots 48 may be used. In the cementing position 32 the central flow passage 46 is communicated with annulus 20 through the plurality of first longitudinal slots 48 and cement flow ports 100. Because there are a plurality of flow ports 100 through which cement is communicated into annulus 20, the placement of cement around the entire circumference of the cementing tool 15 and casing 5 is accomplished. Prior art tools normally include ports with rupture disks, and only one flow port that opens to allow cement to pass therethrough, making it difficult to achieve universal placement of cement, which is easily accomplished with the cementing tool disclosed herein.

In a second position 102 of the setting sleeve 70 and opening sleeve 82 the plurality of circumferentially spaced first longitudinal slots 48 are blocked by opening sleeve 82 such that no flow from the central flow passage 46 therethrough is allowed. However, in the second position 102, which is the set position 30 of the stage cementing tool 15, first longitudinal slots 48 in mandrel 40 are aligned with and communicated with cement flow ports 100 in setting sleeve 70.

Opening sleeve 82 has upper end 104, lower end 106, inner surface 108 and outer surface 110. An opening sleeve seat 112 is defined on opening sleeve 82 and is preferably defined on inner surface 108 thereof between the upper and lower ends 104 and 106 respectively. Opening sleeve seat 112 is sized to receive an opening plug 114 which will be described in more detail hereinbelow. A lock ring 118 is disposed in a groove 120 in the outer surface 110 of opening sleeve 82. O-rings 122 may be disposed in grooves 124 in outer surface 110 of opening sleeve 82.

A drive sleeve 130 is disposed in mandrel 40 above opening sleeve 82. Drive sleeve 130 has upper end 132, lower end 134, inner surface 136 and an outer surface 138. A lock ring 140 is disposed in a groove 142 in outer surface 138. A drive sleeve seat 144 is defined at upper end 132 of drive sleeve 130. Drive sleeve seat 144 may be a separate piece connected to drive sleeve 130 or may simply be defined at the upper end thereof. Drive sleeve seat 144 is sized to receive and engage a drive plug 146 placed into casing 5. The drive plug 146 may be a closing plug which will be operable to prevent communication between central flow passage 46 and the annulus 20, or may be a cancellation plug 150 which may be dropped into casing 5 to prevent cement from flowing from the central flow passage 46 to annulus 20 if it is determined that the cementing is to be cancelled and no cement is to be flowed into the annulus through stage cementing tool 15. An O-ring 152 may be disposed in a groove 154 in outer surface 138 of drive sleeve 130. O-ring 152 will sealingly engage mandrel 40.

A closing sleeve 160 has upper end 162, lower end 164, inner surface 166 and outer surface 168. Outer surface 168 has seals 170 disposed in grooves 172. Seals 170 engage the inner surface 96 of setting sleeve 70 such that closing sleeve 160 and setting sleeve 70 are sealingly engaged. Closing sleeve 160 is detachably connected to mandrel 40 with shear pins 174. Closing sleeve 160 is positioned above setting sleeve 70, and extends downward on mandrel 40 so that a portion of closing sleeve 160 is disposed between setting sleeve 70 and mandrel 40. Mandrel 40 has grooves 176 with O-ring seals 178 therein that seal against closing sleeve 160. Closing sleeve 160 is connected to drive sleeve 130 with drive pins 175 and is movable therewith. Drive pins 175 extend through longitudinal slots 50.

In operation, stage cementing tool 15 is lowered into a desired location in the well on casing 5. Once the desired location is reached, cement is pumped through casing 5, out a bottom of the casing 5 and into annulus 20. After cement is placed in annulus 20, a determination may be made as to whether or not annulus 20 has a sufficient amount of cement so that no additional cement needs to be placed in annulus 20 through cementing tool 15. This determination is made by means known in the art, for example by observing whether there are cement returns at the surface. In situations in which the determination is made that no cement is to be flowed and as a result the stage cementing job is cancelled, a cancellation plug 150 may be dropped into the casing 5. That process is explained in more detail hereinbelow.

If it is determined that second stage cementing is to occur and cement is to be flowed into annulus 20 through cementing tool 15 a freefall opening plug 114 is dropped into casing 5 and is allowed to free fall downwardly therein through any fluid in the casing until it engages opening sleeve seat 112. Once opening sleeve seat 112 is engaged by opening plug 114, pressure thereabove is increased to cause opening sleeve 82 to move from the first position shown in FIG. 2 to the second position shown in FIG. 3. As is apparent from the drawings, opening sleeve seat 112 is located in opening sleeve 82 such that the opening plug 114 landed on opening sleeve seat 112 will be positioned below upper end 104 of opening sleeve 82. The setting sleeve 70 is movable with opening sleeve 82 such that the movement of opening sleeve 82 will move the setting sleeve 70 to its second position 102. Opening sleeve 82 and setting sleeve 70 are initially held in first position by shear pins 74 and by packer 64.

Drive pins 86 will slide downwardly in the plurality of first longitudinal slots 48 from the upper end 52 to the lower end 54 thereof when opening sleeve 82 and setting sleeve 70 move to their second positions. The setting sleeve 70 in its second position moves the packer 64 to its set position against the well. This may be referred to as the set position of the stage cementing tool 15.

Figure 4:
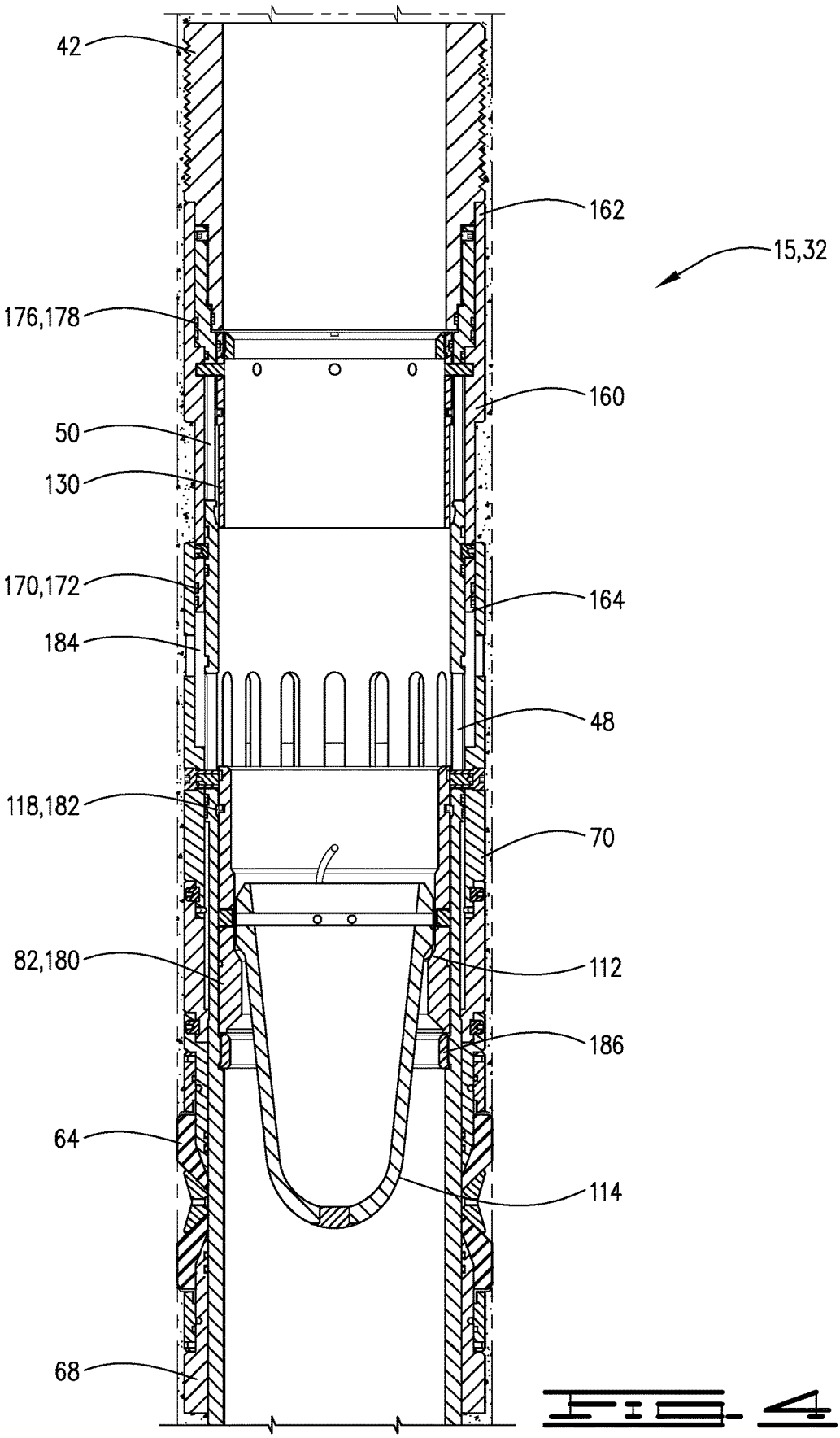
FIG. 4 is a cross section of the stage cementing tool of FIG. 2 in a cementing position.

In order to move the tool to the cementing position 32, additional pressure is applied in the casing and drive pins 86 will break and opening sleeve 82 will be moved to its third position 180. In the third position of the opening sleeve 82, lock ring 118 will expand outwardly into a groove 182 in inner surface 62 of mandrel 40. Lock ring 118 prevents the opening seat from moving upwardly once it is moved to its third position. A seat retainer 186 disposed in mandrel 40 will prevent opening sleeve 82 from moving downwardly past its third position 180. Opening sleeve 82 moves relative to mandrel 40 and to setting sleeve 70 when it moves to the third position. Setting sleeve 70 will remain in its second position 102. This position which is shown in FIG. 4 is referred to as the cementing position. In the cementing position 32, cement may be communicated through the first longitudinal slots 48 and through flow ports 100 to annulus 20. In the cementing position shown in FIG. 4, an annular space 184 is defined by and between mandrel 40 and setting sleeve 70 and fluid, such as cement must flow therethrough to pass through flow ports 100 into annulus 20.

Once a desired amount of cement has been flowed into annulus 20 a drive plug is displaced into casing 5. In the case where cement is flowed into the annulus 20, the drive plug is a closing plug 148. The closing plug 148 may be of a type known in the art that has wipers 149 thereon so that it will urge cement downwardly in casing 5. Closing plug 148 is pumped into casing 5 and will push cement ahead of it through the flow path created by first longitudinal slots 48 and cement flow ports 100. Once closing plug 148 engages drive sleeve seat 144 pressure is increased to break shear pins 174 that connect closing sleeve 70 to mandrel 40.

Figure 5:
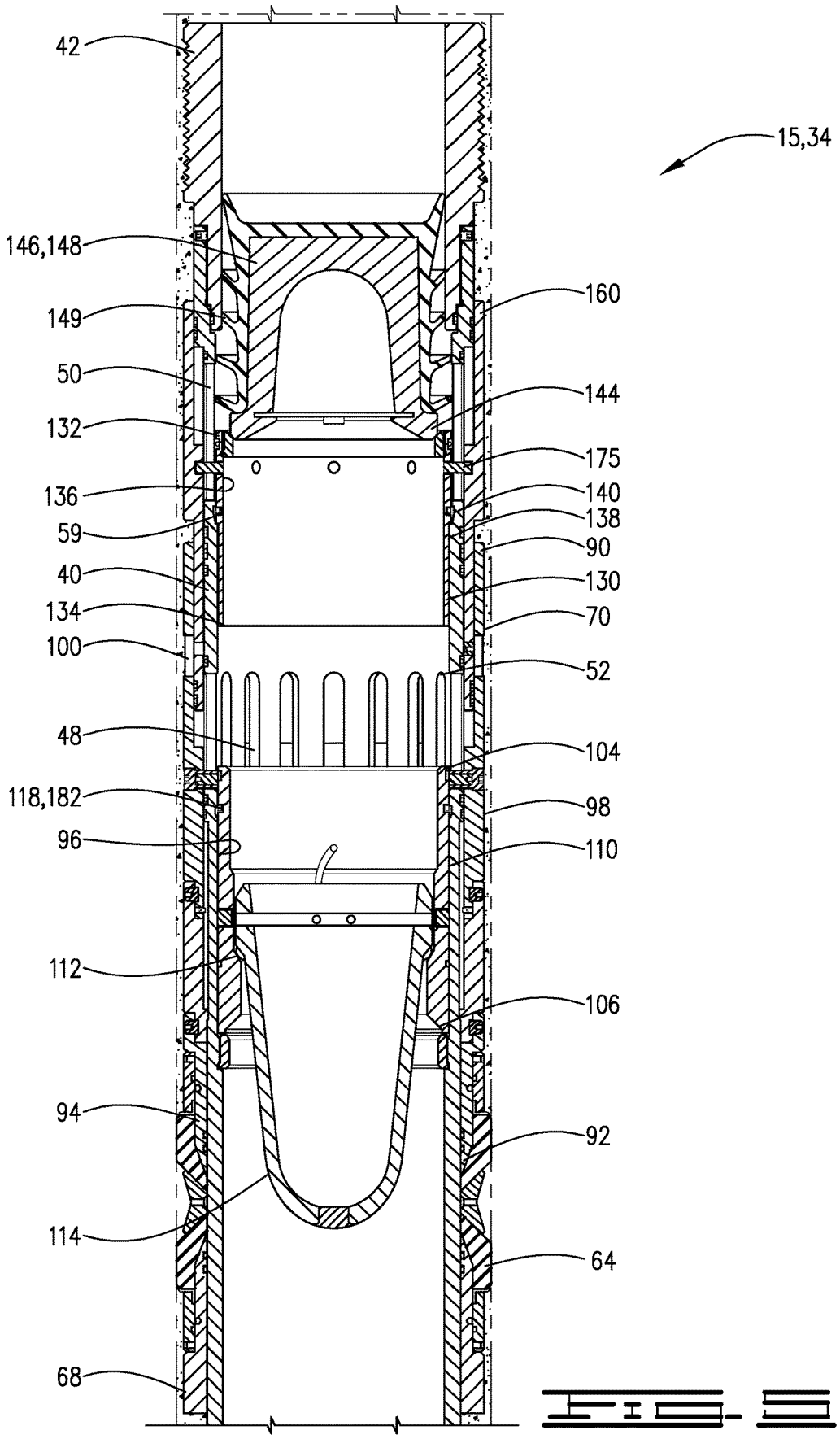
FIG. 5 is a cross section of the stage cementing tool of FIG. 2 in a closed or completed position.
Figure 5:
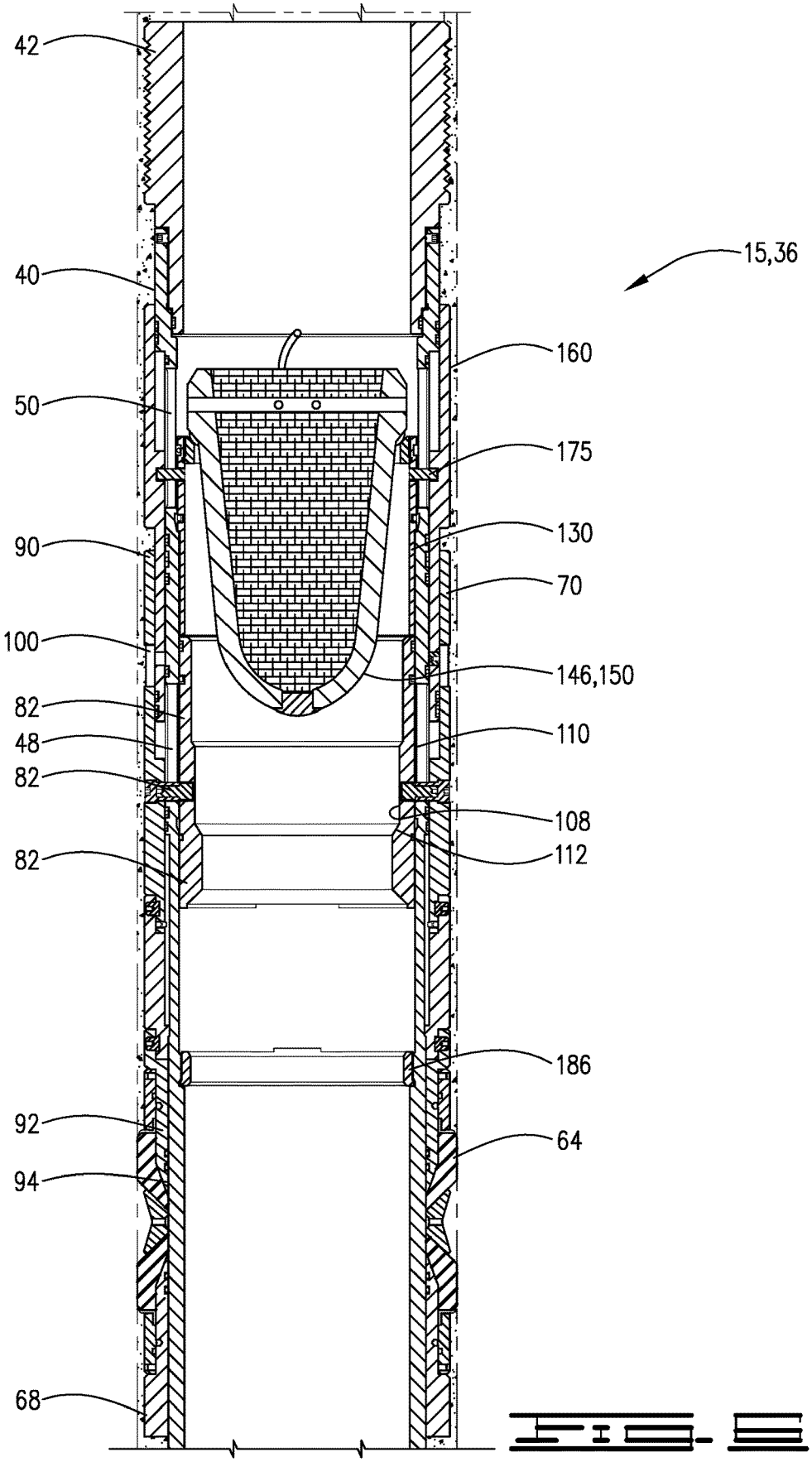

Once shear pins 174 break, drive sleeve 130 and closing sleeve 160 will move downwardly together. The lower end of closing sleeve 160 will be positioned below cement flow ports 100 and will sealingly engage the inner surface 96 of setting sleeve 70 to prevent communication from central flow passage 46 of mandrel 40 into annulus 20. The position shown in FIG. 5 is the completed position of the tool 15, and closing sleeve 160 and drive sleeve 130 are in their second positions. When drive sleeve 130 is in its second position lock ring 140 is received in groove 59 in mandrel 40. Shoulder 61 on mandrel 40 will prevent any further downward movement of drive sleeve 130, for example if pressure is increased thereabove. This is a safety feature to account for increases in pressure for any reason, or when an unexpected or inadvertent increase occurs.

If it is determined that the cement displaced into the annulus 20 through the lower end of casing 5 is sufficient such that second stage cementing is not to be performed with stage cementing tool 15, cementing can be cancelled easily with the stage cementing tool 15. In order to cancel a second stage cementing job a drive plug, which in the case of a cancellation process is a free fall cancellation plug 150, is dropped into casing 5 and allowed to free fall until it engages drive sleeve 130. When the determination is made after the cementing tool 15 is lowered into the well and prior to moving the opening sleeve 82, the cancellation plug 150 is dropped into casing 5. Cancellation plug 150 will not engage the inner surface of the casing and requires no pumping. Cancellation plug 150 simply drops through any fluid in the casing and lands on drive sleeve seat 144. Pressure is then increased above cancellation plug 150 to move drive sleeve 130 downward to engage opening sleeve 82, and to move opening sleeve 82 and setting sleeve 70 to the set position of the tool 15 as depicted in FIG. 7. Drive sleeve 130 pushes opening sleeve 82 down in mandrel 40, moving setting sleeve 70 to the second position which sets the packer 64. Closing sleeve 160 will move down on mandrel 40 with drive sleeve 130 and communication between central flow passage 46 and annulus 20 is prevented during the entire cancellation process, so that there is no chance of communication therebetween during the cancellation of the cementing job. As shown in FIG. 7 opening sleeve 82 covers first longitudinal slots 48 and closing sleeve 160 is positioned between mandrel 40 and setting sleeve 70 to block flow ports 100 and prevent communication therethrough. With prior art tools, there is a moment of time in which communication from a flow passage of the prior art tool is communicated with the well annulus during the cancellation process. With known second stage cementing tools, there is a temporary (very short) time frame when sleeves are shifting in which there is communication from the central flow passage of the tool to the annulus. This can create a risk of fluid inflow from the annulus to the central flow passage of the tool, a lack of pressure integrity during the cancellation process, a potential injection of well fluids into cement and seals crossing flow ports. The stage cementing tool 15 completely prevents communication between the central flow passage 46 of stage cementing tool 15 and the annulus 20 during the cancellation process. The foregoing cancellation process may be referred to as the primary cancellation process, in which the determination to cancel is made prior to the shifting of the opening sleeve, or any other sleeves.

In some cases, the cementing tool 15 may be moved to the cementing position 32, and then the determination is made to cancel. In those situations, a cancellation plug 150 is dropped as described above. The cancellation process occurring after the opening sleeve 82 has been shifted may be referred to as the secondary cancellation process. In the secondary cancellation process the cancellation plug 150 will free fall downward until it engages drive sleeve seat 144. Opening plug 114, which is engaged with opening sleeve seat 112, is located far enough below the upper end 104 of opening sleeve 82 to allow cancellation plug 150 to land. Such an arrangement is not feasible with prior art tools. Prior art tools are generally opened with a plug that engages the upper end of the prior art opening sleeve. As a result, there is no room for a cancellation plug. Instead, a closing plug with wipers must be used, and additional cement pumped into the annulus ahead of the closing plug even though the additional cement is not needed. The stage cementing tool 15 disclosed herein allows a job to be cancelled after an opening plug has engaged opening sleeve 82 and the tool 15 is moved to the cementing position.

Embodiment 1: A stage cementing tool for use in a wellbore comprising a mandrel having a plurality of circumferentially spaced first longitudinal slots and a plurality of circumferentially spaced second longitudinal slots, the plurality of circumferentially spaced second longitudinal slots being spaced longitudinally from the plurality of circumferentially spaced first longitudinal slots, an opening sleeve disposed in the mandrel in a first position and movable relative thereto, a setting sleeve disposed about the mandrel in a first position and movable relative thereto, the setting sleeve connected to the opening sleeve with connecting pins extending through the longitudinal slots in the plurality of the circumferentially spaced first longitudinal slots, the opening sleeve and setting sleeve movable together, the drive sleeve disposed in the mandrel above the opening sleeve and movable relative to the mandrel, and a closing sleeve disposed about the mandrel and connected to the drive sleeve with drive pins extending through the plurality of circumferentially spaced second longitudinal slots, the drive sleeve and closing sleeve movable together.

Embodiment 2: The stage cementing tool of embodiment 1 further comprising a settable packer disposed about the mandrel, the opening sleeve and setting sleeve movable together to a second position in which the setting sleeve moves the packer from an unset to a set position against the wellbore.

Embodiment 3: The stage cementing tool of embodiment 2, the drive sleeve engageable with the opening sleeve and movable to a second position of the drive sleeve, the drive sleeve operable to engage and move the opening sleeve and the setting sleeve to the second position without establishing communication between a central flow passage of the stage cementing tool and an annulus defined by the stage cementing tool and the wellbore.

Embodiment 4: The stage cementing tool of either of embodiments 2 or 3, further comprising a lock ring disposed about the drive sleeve, the mandrel having an upward facing shoulder thereon, the upward facing shoulder engageable with the lock ring on the drive sleeve to prevent the drive sleeve from moving past the second position of the drive sleeve.

Embodiment 5: The stage cementing tool of any of embodiments 2-4, the opening sleeve having an opening seat defined thereon, the opening sleeve movable from the first to the second position upon the application of pressure above an opening plug landed on the opening seat, the opening sleeve movable relative to the mandrel and the setting sleeve to a third position in the mandrel in which communication is permitted through the plurality of circumferentially spaced first longitudinal slots from a central flow passage of the mandrel to an annulus defined between the cementing tool and the wellbore.

Embodiment 6: The stage cementing tool of embodiment 5, the setting sleeve having a plurality of flow ports defined therethrough, the central flow passage communicated with the annulus through the plurality of circumferentially spaced first longitudinal slots and the flow ports in the setting sleeve when the opening sleeve is in the third position.

Embodiment 7: The stage cementing tool of either of embodiments 5 and 6, the closing sleeve being movable from a first closing sleeve position to a second closing sleeve position in which the closing sleeve blocks the flow ports in the setting sleeve to prevent communication therethrough to the annulus.

Embodiment 8: The stage cementing tool of any of embodiments 2-7 further comprising an opening plug landed on an opening seat defined in the opening sleeve and a drive plug landed on a seat defined by the driving sleeve.

Embodiment 9: A method comprising providing a stage cementing tool, the stage cementing tool comprising a mandrel defining a central flow passage therethrough and having a plurality of circumferentially spaced first longitudinal slots and a plurality of circumferentially spaced second longitudinal slots defined therein, the plurality of circumferentially spaced second longitudinal slots being longitudinally spaced from the plurality of circumferentially spaced first longitudinal slots; an opening sleeve disposed in the mandrel in a first position covering the plurality of circumferentially spaced first longitudinal slots and movable relative to the mandrel to allow communication through the plurality of circumferentially spaced first longitudinal slots; a drive sleeve disposed in the mandrel above the opening sleeve; and drive pins extending through at least some of the plurality of circumferentially spaced second longitudinal slots connecting the drive sleeve with a closing sleeve disposed about the mandrel; the method comprising lowering the stage cementing tool into a wellbore on a casing to a desired location; dropping a cancellation plug into the casing to cancel cementing through the stage cementing tool without establishing communication between the central flow passage and the well.

Embodiment 10: The method of embodiment 9, the cementing tool further comprising a packer disposed about the mandrel and a setting sleeve disposed about the mandrel, the setting sleeve connected to and movable with the opening sleeve, the method further comprising moving the opening sleeve and setting sleeve downward to move the packer to a set position against the wellbore.

Embodiment 11: The method of either of embodiments 9 or 10, wherein the setting step occurs after the cancellation plug is displaced into the casing.

Embodiment 12: The method of embodiment 11, the setting step comprising engaging a seat defined on the drive sleeve with the cancellation plug; increasing the pressure in the casing after the cancellation plug has engaged the drive sleeve; and pushing the opening sleeve downwardly in the mandrel with the drive sleeve to move the packer to the set position.

Embodiment 13: A stage cementing tool for use in a wellbore comprising a casing, the casing and wellbore defining an annulus therebetween; a mandrel having a plurality of first longitudinal slots defined therein and a plurality of second longitudinal slots defined therein connected in the casing, the plurality of second longitudinal slots spaced longitudinally from the plurality of first longitudinal slots; a drive sleeve disposed in the mandrel; an opening sleeve disposed in the mandrel in a first position covering the first longitudinal slots to prevent communication from a central flow passage of the mandrel to the annulus; a setting sleeve connected to the opening sleeve with a plurality of opening sleeve pins extending through the plurality of first longitudinal slots; and a packer disposed about the mandrel, the drive sleeve engageable with the opening sleeve and operable to move the opening sleeve and the setting sleeve to a second position in which the setting sleeve moves the packer to a set position against the wellbore.

Embodiment 14: The cementing tool of embodiment 13, the opening sleeve movable from the second to a third position to uncover the first plurality of longitudinal slots and allow communication from the central flow passage through the first plurality of longitudinal slots.

Embodiment 15: The cementing tool of embodiment 14, the setting sleeve having a plurality of flow ports therethrough, wherein cement communicated to the annulus is communicated through the plurality of first longitudinal slots and the plurality of flow ports in the setting sleeve.

Embodiment 16: The cementing tool of either of embodiments 14 and 15, the setting sleeve and the mandrel defining an annular space therebetween through which cement is flowed into the annulus.

Embodiment 17: The cementing tool of embodiment 16 further comprising the drive sleeve defining a drive sleeve seat for receiving a drive plug displaced into the mandrel and movable to a second position of the drive sleeve upon the application of pressure above the drive plug, wherein in the second position of the drive sleeve no communication is permitted through the plurality of circumferentially spaced first longitudinal slots to the annulus.

Embodiment 18: The cementing tool of any of embodiments 13-17, further comprising a freefall plug delivered into the mandrel and seated on the drive sleeve prior to setting the packer.

Embodiment 19: The cementing tool of any of embodiments 13-18, further comprising an opening plug delivered into the mandrel and seated on the opening sleeve and a freefall cancellation plug seated on the drive sleeve.

Embodiment 20: The cementing tool of embodiment 19, further comprising the freefall cancellation plug delivered into the mandrel and seated on the drive sleeve after the opening sleeve has moved to a third position in which communication to the annulus is established through the plurality of first longitudinal slots.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A stage cementing tool for use in a wellbore comprising:

a mandrel having a plurality of circumferentially spaced first longitudinal slots and a plurality of circumferentially spaced second longitudinal slots, the plurality of circumferentially spaced second longitudinal slots being spaced longitudinally from the plurality of circumferentially spaced first longitudinal slots;

an opening sleeve disposed in the mandrel in a first position and movable relative thereto;

a setting sleeve disposed about the mandrel in a first position and movable relative thereto;

the setting sleeve having a plurality of flow ports defined therethrough and being connected to the opening sleeve with connecting pins extending through the longitudinal slots in the plurality of the circumferentially spaced first longitudinal slots, the opening sleeve and setting sleeve movable together;

a drive sleeve disposed in the mandrel above the opening sleeve and movable relative to the mandrel; and a closing sleeve disposed about the mandrel and connected to the drive sleeve with drive pins extending through the plurality of circumferentially spaced second longitudinal slots, the drive sleeve and closing sleeve movable together, a portion of the closing sleeve being sandwiched between the mandrel and the setting sleeve, the flow ports in the setting sleeve being covered by the closing sleeve in the first position of the setting sleeve.

2. The stage cementing tool of claim 1 further comprising a settable packer disposed about the mandrel, the opening sleeve and setting sleeve movable together to a second position in which the setting sleeve moves the packer from an unset to a set position against the wellbore, the first longitudinal slots being in communication with the flow ports in the setting sleeve in the second position of the setting sleeve.

3. The stage cementing tool of claim 1, the drive sleeve engageable with the opening sleeve and movable to a second position of the drive sleeve, the drive sleeve operable to engage and move the opening sleeve and the setting sleeve to the second position in which the setting sleeve moves a settable packer from an unset to a set position in the wellbore without establishing communication between a central flow passage of the stage cementing tool and an annulus defined by the stage cementing tool and the wellbore.

4. The stage cementing tool of claim 2, further comprising a lock ring disposed about the drive sleeve, the mandrel having an upward facing shoulder thereon, the upward facing shoulder engageable with the lock ring on the drive sleeve to prevent the drive sleeve from moving past the second position of the drive sleeve.

5. The stage cementing tool of claim 2, the opening sleeve having an opening seat defined thereon, the opening sleeve movable from the first to the second position upon the application of pressure above an opening plug landed on the opening seat, the opening sleeve movable relative to the mandrel and the setting sleeve to a third position in the mandrel in which communication is permitted through the plurality of circumferentially spaced first longitudinal slots from a central flow passage of the mandrel to an annulus defined between the cementing tool and the wellbore.

6. The stage cementing tool of claim 5, the central flow passage communicated with the annulus through the plurality of circumferentially spaced first longitudinal slots and the flow ports in the setting sleeve when the opening sleeve is in the third position.

7. The stage cementing tool of claim 5, the closing sleeve being movable from a first closing sleeve position to a second closing sleeve position in which the closing sleeve blocks the flow ports in the setting sleeve to prevent communication therethrough to the annulus.

8. The stage cementing tool of claim 2 further comprising:

an opening plug landed on an opening seat defined in the opening sleeve; and a drive plug landed on a seat defined by the driving sleeve.

9. A method comprising:

providing a stage cementing tool comprising:

a mandrel defining a central flow passage therethrough and having a plurality of circumferentially spaced first longitudinal slots and a plurality of circumferentially spaced second longitudinal slots defined therein, the plurality of circumferentially spaced second longitudinal slots being longitudinally spaced from the plurality of circumferentially spaced first longitudinal slots;

an opening sleeve disposed in the mandrel in a first position covering the plurality of circumferentially spaced first longitudinal slots and movable relative to the mandrel to allow communication through the plurality of circumferentially spaced first longitudinal slots;

a setting sleeve disposed about the mandrel and connected to the opening sleeve with drive pins extending through the circumferentially spaced first longitudinal slots;

a drive sleeve disposed in the mandrel above the opening sleeve; and drive pins extending through at least some of the plurality of circumferentially spaced second longitudinal slots connecting the drive sleeve with a closing sleeve disposed about the mandrel, a portion of the closing sleeve being sandwiched between the mandrel and the setting sleeve;

lowering the stage cementing tool into a wellbore on a casing to a desired location; and dropping a cancellation plug into the casing to cancel cementing through the stage cementing tool without establishing communication between the central flow passage and the well.

10. The method of claim 9, the cementing tool further comprising a packer disposed about the mandrel, the method further comprising moving the opening sleeve and setting sleeve downward to move the packer to a set position against the wellbore.

11. The method of claim 10, wherein the setting step occurs after the cancellation plug is displaced into the casing.

12. The method of claim 11, the setting step comprising:

engaging a seat defined on the drive sleeve with the cancellation plug;

increasing the pressure in the casing after the cancellation plug has engaged the drive sleeve; and pushing the opening sleeve downwardly in the mandrel with the drive sleeve to move the packer to the set position.

13. A stage cementing tool for use in a wellbore comprising:

a casing, the casing and wellbore defining an annulus therebetween;

a mandrel having a plurality of first longitudinal slots defined therein and a plurality of second longitudinal slots defined therein connected in the casing, the plurality of second longitudinal slots spaced longitudinally from the plurality of first longitudinal slots;

a drive sleeve disposed in the mandrel;

a closing sleeve disposed about the mandrel and connected to the drive sleeve through the first longitudinal slots;

an opening sleeve disposed in the mandrel in a first position covering the first longitudinal slots to prevent communication from a central flow passage of the mandrel to the annulus;

a setting sleeve connected to the opening sleeve with a plurality of opening sleeve pins extending through the plurality of first longitudinal slots, a portion of the closing sleeve being sandwiched between the mandrel and the setting sleeve; and a packer disposed about the mandrel, the drive sleeve engageable with the opening sleeve and operable to move the opening sleeve and the setting sleeve to a second position in which the setting sleeve moves the packer to a set position against the wellbore.

14. The cementing tool of claim 13, the opening sleeve movable from the second to a third position to uncover the first plurality of longitudinal slots and allow communication from the central flow passage through the first plurality of longitudinal slots.

15. The cementing tool of claim 14, the setting sleeve having a plurality of flow ports therethrough, wherein cement communicated to the annulus is communicated through the plurality of first longitudinal slots and the plurality of flow ports in the setting sleeve.

16. The cementing tool of claim 14, the setting sleeve and the mandrel defining an annular space therebetween through which cement is flowed into the annulus.

17. The cementing tool of claim 16 further comprising the drive sleeve defining a drive sleeve seat for receiving a drive plug displaced into the mandrel and movable to a second position of the drive sleeve upon the application of pressure above the drive plug, wherein in the second position of the drive sleeve no communication is permitted through the plurality of circumferentially spaced first longitudinal slots to the annulus.

18. The cementing tool of claim 13, further comprising a freefall plug delivered into the mandrel and seated on the drive sleeve prior to setting the packer.

19. The cementing tool of claim 13, further comprising an opening plug delivered into the mandrel and seated on the opening sleeve and a freefall cancellation plug seated on the drive sleeve.

20. The cementing tool of claim 19, further comprising the freefall cancellation plug delivered into the mandrel and seated on the drive sleeve after the opening sleeve has moved to a third position in which communication to the annulus is established through the plurality of first longitudinal slots.

* * * * *